US005943544A

United States Patent [19]

Morita et al.

[11] Patent Number: 5,943,544

[45] Date of Patent: Aug. 24, 1999

[54] METHOD FOR MANUFACTURE OF PRECIOUS METAL PRODUCT

[75] Inventors: Noboru Morita, Tokyo; Katuhiko Shimamoto, Hino, both of Japan

[73] Assignee: Aida Chemical Industries Co., Ltd., Tokyo, Japan

[21] Appl. No.: 09/014,628

[22] Filed: Jan. 28, 1998

[30] Foreign Application Priority Data

Jan. 30, 1997 [JP] Japan ..... 9-17157

[51] Int. Cl.[6] ..... B22F 7/02

[52] U.S. Cl. ..... 419/5

[58] Field of Search ..... 419/5; 75/247

[56] References Cited

U.S. PATENT DOCUMENTS

| | | | |
|---|---|---|---|
| 4,854,970 | 8/1989 | Wiech, Jr. | 106/286.1 |
| 5,328,775 | 7/1994 | Hoshino et al. | 428/560 |
| 5,376,328 | 12/1994 | Hoshino et al. | 419/36 |
| 5,578,383 | 11/1996 | Beyer et al. | 428/551 |
| 5,702,501 | 12/1997 | Osawa et al. | 75/255 |

FOREIGN PATENT DOCUMENTS

| | | |
|---|---|---|
| 0 457 350 | 11/1991 | European Pat. Off. . |
| 38 41 903 | 6/1990 | Germany . |
| 4-26707 | 1/1992 | Japan . |
| 4-66605 | 3/1992 | Japan . |
| 4-346606 | 12/1992 | Japan . |
| 5-140611 | 6/1993 | Japan . |
| 6-99723 | 12/1994 | Japan . |

OTHER PUBLICATIONS

Patent Abstracts of Japan, vol. 096, No. 006, Jun. 28, 1996, JP 08 053 701, Feb. 27, 1996.

Patent Abstracts of Japan, vol. 017, No. 510 (M–1480), Sep. 14, 1993, JP 05 132 702, May 28, 1993.

Patent Abstracts of Japan, vol. 097, No. 002, Feb. 28, 1997, JP 08 269 503, Oct. 15, 1996.

*Primary Examiner*—Ngoclan Mai

*Attorney, Agent, or Firm*—Oblon, Spivak, McClelland, Maier & Neustadt, P.C.

[57] ABSTRACT

A method for the manufacture of a precious metal product is disclosed which consists essentially of the steps of forming in a desired shape a clayish composition essentially consisting of a precious metal powder, an organic binder, and water, solidifying the formed clayish composition to obtain a solid formed mass, attaching an accessory member fast to the solid formed mass with a portion of the clayish composition serving as an adhesive agent, and firing the resultant composite having the accessory member fastened to the solid formed mass.

7 Claims, 3 Drawing Sheets

METHOD FOR MANUFACTURE OF PRECIOUS METAL PRODUCT

BACKGROUND OF THE INVENTION

1. Field of the Invention

This invention relates to a method for the manufacture of a precious metal product using a clayish composition based on a precious metal powder and more particularly to a method for the manufacture of a precious metal product, which method is capable of fixing an accessory such as a gem or a metallic part such as a creaser or loket bails accurately at an intended position with ample strength to a matrix.

2. Prior Art Statement

Clayish compositions containing a precious metal powder are easy to form and, therefore, are manufactured in various shapes and designs such as pendant tops, rings, brooches, and pierces, and fired and marketed as precious metal goods. As a means to integrate such an accessory as a gem with a precious metal product, the method disclosed in Japanese Patent Public Disclosure Hei 04-146606 is known. This method accomplishes the integration by forcing an accessory made of a material having a higher melting point than the precious metal powder into a formed mass of a clayey composition in a plastic state until it is set in place therein and firing the resultant composite thereby enabling the formed mass to shrink and take firm hold of the accessory with powerful constraining force.

This method, therefore, obviates the necessity of relying on such a highly expert technique as "brazing" or "caulking" as has been heretofore adopted in the fixation of an accessory and also enjoys the advantage of ensuring manufacture of a product free of discoloration, a fault apt to arise in brazing.

Since the clayish composition used in this method contains a large amount binder, however, it is destined to exhibit a large final shrinkage falling in the range of 15–26% upon sintering. Depending on the volume and shape of the formed mass, therefore, this method is incapable of enabling the accessory fixed in the product finished by the sintering to be retained accurately at the target position.

Even when a gem as an accessory is forced into an undried formed mass until it is accurately set in place therein, once sintered, the table (the smooth central part) of the gem in the resultant composite is liable to tilt, possibly to the extent of causing the gem to rise above or sink under the desired position. Moreover, the degree with which the final seat of the gem deviates from the target position tends to grow in direct proportion to the variation in wall thickness of the formed mass, the ruggedness of the surface of the formed mass, and the number of accessories to be set.

This deviation in position is thought to occur because the formed mass which theoretically ought to shrink evenly actually develops strain or internal stress, fails to shrink evenly, and consequently deforms because the wall thickness thereof locally varies or because the shrinkage thereof due to drying or sintering proceeds earlier near the surface thereof than in the interior.

Further, since the method mentioned above causes the gem to set firmly in position in the sintered composite owing to the voluminal contraction occurring during sintering, the inaccurately mounted gem can no longer be adjusted in orientation or be removed.

The method also requires the accessory to withstand a temperature higher than the sintering temperature of the precious metal powder. It, therefore, cannot be safely applied to such accessories as pearl and amber which are thermally decomposed below the sintering temperature or to natural precious stones or semi-precious stones which may be discolored or fractured when heated to elevated temperatures.

SUMMARY OF THE INVENTION

The present invention has been proposed in view of the state of prior art mentioned above. It concerns a method for the manufacture of a precious metal product, consisting essentially of the steps of forming in a required shape a clayish composition consisting essentially of a precious metal powder, an organic binder and water, solidifying the formed clayish composition to obtain a solid formed mass, attaching an accessory member fast to the solid formed mass with the clayish composition serving as an adhesive agent, and firing the resultant composite having the accessory member fastened to the solid formed mass.

The solidification mentioned above is effected by drying or sintering.

This invention also embraces a method which comprises preparatorily forming a site selected in the solid formed mass for the attachment of the accessory member and subsequently attaching the accessory member to the formed site.

PREFERRED EMBODIMENTS OF THE INVENTION

Figure 1A:
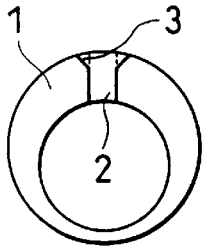
FIGS. 1A, 1B and 1C are schematic diagrams illustrating the process of manufacture used in Example 1.

The clayish composition used in this invention is produced by kneading a metal powder formed of at least one member selected from the group consisting of simple metals and alloys thereof with an organic binder, water, etc.

Usable metal powders include those comprising at least one member selected from the group consisting of such precious metals as Au, Ag, Pt, Pd, Rh, Ru, Ir, and Os and alloys thereof. Preferably, the metal powder has not less than 90% of the whole weight thereof formed of particles having diameters in the range of 1–100 $\mu$m. It is particularly preferred to have an average particle diameter in the range of 5–30 $\mu$m and an appropriate range of particle size distribution. A metal powder meeting these conditions advantageously allows the minute particles thereof to fill the interstices occurring between the remaining coarse particles and, therefore, acquiring a highly densified state as a whole and consequently allowing manufacture of a precious metal sinter which exhibits only low shrinkage in the process of sintering.

The organic binder used herein may be any of the known water-soluble binding agents such as, for example, water-soluble celluloses, water-soluble acryls, polyvinyl alcohols (PVA), and polysaccharides including starch and dextrin.

After the metal powder and the organic binder have been mixed, the produced mixture requires addition of water in an proper amount. If the amount of this water is unduly small, the clayish composition consequently obtained will be so hard as to make the required formation difficult. If the amount is unduly large, the produced clayish composition will acquire no shape-retaining property. This makes required formation difficult and increases the likelihood of heavy adherence to the hands and the tools used for the formation. The ratio of the metal powder to the final mixture preferably falls in the range of 90–99 wt %.

When the clayish composition used contains 0.02–4.0 wt % (preferably 0.02–3.0 wt %) of starch, 0.02–4.0 wt % (preferably 0.02–3.0 wt %) of such a water-soluble cellulose as methyl cellulose, and 0–3.0 wt % of pulp fibers as organic binders, it does not easily adhere to the hands in the process of formation. The formed mass which is made of this clayish composition acquires improved drying strength and a prolonged period of mass formability because the formed mass can prevent cracking during drying.

The incorporation of starch enhances the strength of the formed mass during drying. Even when the clayish composition is extruded from a syringe into a fine thread, for example, the fine thread neither deforms nor fractures during drying. If the ratio of the starch is less than the lower limit of the range mentioned above, the formed mass of the clayish composition will not have sufficient strength during drying and will tend to crack during mold release, for example. If the ratio exceeds the upper limit of the range mentioned above, the produced clayish composition will acquire elasticity, making the formation in a desired shape difficult, tend to sustain a cracks in the formed mass, and experience increased shrinkage.

The incorporation of the water-soluble cellulose prevents the occurrence of cracks in the formed mass and also precludes adhesion of the clayish composition to the hands. If the ratio of this water-soluble cellulose is less than the lower limit of the range mentioned above, the component fails to manifest its full effect. If the ratio exceeds the upper limit of the range mentioned above, the clayish composition readily adheres to the hands and exhibits additional shrinkage. Water-soluble celluloses usable herein include methyl cellulose, hydroxyethyl cellulose, hydroxypropyl cellulose, and hydroxy-propyl methyl cellulose, for example.

The incorporation of pulp fibers helps the clayish composition to retain water and elongates its period of mass formability. In addition, it prevents the formed mass from sustaining cracks, similarly to the water-soluble cellulose mentioned above. If the contact of the pulp fibers incorporated exceeds the upper limit of the range mentioned above, the clayish composition exhibits additional shrinkage.

The amount of the organic binder composed of the starch, water-soluble cellulose and pulp fibers mentioned above is preferred to be in the range of 0.1–10 wt %, based on the total amount of the clayish composition. If the content of the organic binder is less than 0.1 wt %, the clayish composition will be deficient in formability and the formed mass thereof will exhibit poor shape retention. Further, the formed mass, when dried, will manifest weak strength. If the content of the organic binder exceeds 10 wt %, the produced clayish composition will show an appreciable increase in adhesiveness to the hands. This clayish composition will be difficulty to form in a desired shape and, even if forming is possible, the formed mass will not plastically deform but exhibit elasticity.

Even when the highest temperature endurable by the gem or other accessory to be fixed is lower than the sintering temperature of the metal powder component of the clayish composition, this invention can be applied effectively to mount the accessory via a metallic part (setter) so long as the metallic part is made of a material having a high endurance temperature (melting point).

This invention consists essentially of a first step of forming the clayish composition in a desired shape and then drying or sintering the formed mass of the clayish composition to obtain a solid formed mass, a second step of fixing to the solid formed mass an accessory or a metallic part by using a minute amount of the clayish composition as an adhesive agent, and a third step of sintering the resultant composite under proper conditions. Optionally, it further comprises a step of fitting an accessory to the metallic part (setter).

At the first step, the clayish composition is formed in a desired shape and the formed clayish composition is dried by dehydration in a drier kept at a temperature of 50–100° C., for example, or/and sintered with an electric furnace, a microwave heat generator, or a gas burner. The means adopted for the drying or firing herein is not subject to restriction but may be selected from among means well known to the art. The salient feature of the method of this invention is that the formation of the clayish composition can be implemented in any arbitrary shape. The clayish composition can therefore be formed in such various shapes and designs as, for example, pendant tops, rings, brooches, and pierces. Optionally, a metallic material manufactured by casting may be additionally used. For example, a formed body (matrix) may be obtained by preparing a metallic ring by the lost wax technique and then coating or decorating the surface of the metallic ring with the clayish composition.

At the second step, an accessory or a metallic part is fixed at a specific position of the dried formed mass or sintered formed mass obtained at the first step by using a minute amount of the clayish composition as an adhesive agent. The accessory or the metallic part to be used herein is required to endure a temperature higher than the sintering temperature of the metal powder used as one component of the clayish composition. For example, synthetic ruby or synthetic sapphire is used as the accessory and a metal or an alloy having a high melting point is used for the metallic part. Concrete examples of the metallic part include, for example, metallic products made of a material and formed in a shape intended for decoration, stone setters formed in varying shapes resembling cones, circular rings, shanked pieces, clawed pieces and pinned pieces, metallic setters such as jump rings and loket bails, and brooches.

The clayish composition used at the second step is intended for ensuring secure fixation of an accessory or a metallic part at a proper position and is preferred to be used in the minimum amount possible. Specifically, when a gem of cubochon cut (semispherical shape) is to be fixed, for example, to a flat part of the dried formed mass or sintered formed mass destined to form a matrix body, it suffices to apply the adhesive clayish composition to the matrix body to slightly cover the outer edge of the gem. Optionally, the clayish composition may be interposed additionally along the interface between the gem and the matrix body.

The dried formed mass exhibits low plasticity and high breaking strength, permits very easy manual fabrication by cutting or drilling, and allows corrective fabrication by applying additional clayish composition added with extra water.

In the completely dried formed mass, the deformation (strain) which occurs during the shrinkage due to the loss of water has run its course. Therefore, when the shape of the formed mass requires correction, effecting the corrective work (shape adjustment) at the second step substantially prevents the formed mass from being deformed by inner stress during sintering. When the accessory or the metallic part to be fixed is used singly, it may be fixed to the formed mass in a dry state. When the formed mass is large in thickness, volume and surface area, it may generate slight strain additionally during firing. When the mounting position is required to be highly accurate, therefore, the fixation is preferred to be made to the formed mass (matrix) which has already undergone sintering. Where the mounting of a plurality of accessories or metallic parts is contemplated, the fixation is preferable performed on the sintered formed mass because even a slight tilt is liable to be conspicuous.

Subsequently at the third step, the precious metal product having an accessory or a metallic part fixed thereto can be obtained by sintering the formed mass under proper sintering conditions. The precious metal product thus obtained has the accessory or the metallic part fixed thereto at an accurate position with ample strength.

By the sintering performed at the third step, the minute amount of the clayish composition used at the second step is exclusively shrunk because nearly all the parts of the formed mass were substantially (in the fixation of the accessory or the metallic part to the dried formed mass) or completely (in the fixation of the accessory or the metallic part to the sintered formed mass) shrunk at the first step. This sintering, therefore, hardly ever causes the table of the gem to tilt to an extent of causing the gem to rise from or sink under the desired position.

When the accessory is made of a natural precious stone or semi-precious stone, pearl, amber or colored glass which cannot be heated safely to the sintering temperature of the formed mass, it is fixed by a physical means to the stone setter (metallic part) already fixed by sintering to the matrix body.

The method of this invention further embraces the concept of forming the position for fixing a fitting member to the solid formed mass in advance of effecting the fixation of the fitting member to the solid formed mass by using the clayish composition as an adhesive agent.

This is aimed at enabling the accessory or the metallic part to be fixed more securely to the matrix body or, where a gem pervious to light is used for an accessory, at enabling the gem to scintillate more brilliantly as by drilling holes for passage of light in the seat of fixation.

Optionally, an appropriate fixing member may be obtained by imparting through-holes or grooves to the formed mass immediately after the formation thereof (prior to the drying) and then finely adjusting the holes or grooves in shape as by grinding after the step of drying or sintering.

The present invention will now be described specifically below with reference to working examples.

EXAMPLE 1

Manufacture of Product Having Synthetic Ruby of Round Brilliant Cut Fixed to a Ring An Ag-containing clayish composition obtained by mixing 91 wt % of Ag powder, 20 $\mu$m in average particle diameter, 1 wt % of methyl cellulose, 1 wt % of starch, and 1 wt % of pulp fibers and kneading the resultant mixture with 6 wt % of water added thereto was formed in the shape of a ring. The formed clayish composition was dried and hardened for one hour in a drier kept at 70° C. to obtain a dry formed mass 1 of the shape of a ring (FIG. 1).

Then, a through hole 2, 1 mm in diameter, was bored with a drill in the dry formed mass 1 as illustrated in FIG. 1A and a fixing part 3 was obtained by scraping the peripheral lateral part of the through hole 2 until this part assumed the appearance of a mortar.

Figure 1B:
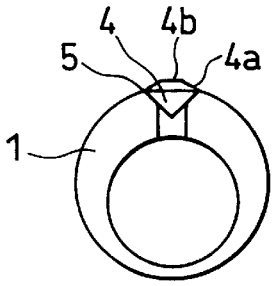

Subsequently, a synthetic ruby 4 of round brilliant cut was set in position in the fixing part (fitting part) 3 as shown in FIG. 1B and a minute amount of the Ag-containing clayish composition 5 mentioned above was applied to a peripheral crown part 4*a* of the synthetic ruby 4 so as to adhere the ruby to the wall surface of the fixing part 3.

Figure 1C:
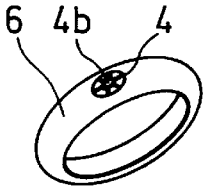

The formed mass of the shape of a ring manufactured by the procedure described above was placed in an electric furnace having the interior thereof kept at 800° C., heated therein for 30 minutes, removed from the electric furnace, and left standing to cool to room temperature. As a result, a beautiful ring 6 having the table part (top flat surface) of the synthetic ruby 4 positioned precisely as shown in FIG. 1C and fixed with ample strength was obtained.

EXAMPLE 2

Example of Manufacture of Product Having a Plurality of Synthetic Sapphires of Cubochon Cut Fixed to a Pendant Top of the Shape of a Planar Heart The same Ag-containing clayish composition as used in Example 1 was formed in the shape of a heart-like plate, 1.5 mm in thickness and solidified by drying at 90° C. for 30 minutes. The solid heart-like plate was placed on a metallic gauze made of stainless steel and heated uniformly with the flame of a cooking propane gas burner until red hot. Consequently, a sintered formed mass 7 was obtained.

Figure 2A:
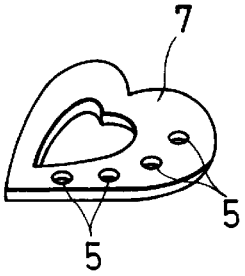
FIGS. 2A, 2B and 2C are schematic diagrams illustrating the process of manufacture used in Example 2.
Figure 2B:
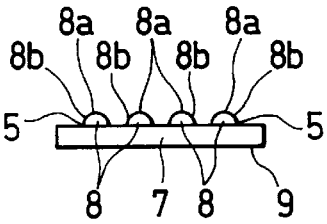

Then, a minute amount of the Ag-containing clayish composition 5 was applied in the form of drops at suitable places (four points) on the upper surface of the sintered formed mass 7 as shown in FIG. 2A. Synthetic sapphires 8 of a cubochon cut were mounted one each on the drops of the Ag-containing clayish composition 5 and crown parts 8*a* of the synthetic sapphires were gently depressed until the Ag-containing clayish composition 5 covered the outer peripheral part 8*b* in an annular pattern as shown in FIG. 2B.

The heart-like formed mass 9 of the shape of a pendant top manufactured by the procedure described above was set in position in an electric furnace having the interior thereof kept at 800° C., heated therein for 30 minutes, removed from the electric furnace, and left standing to cool to room temperature.

Figure 2C:
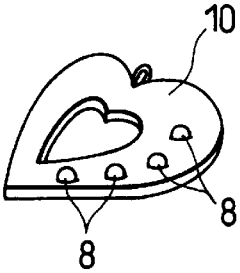

As a result, a beautiful heart-like product 10 of the shape of a pendant top having the synthetic sapphires 8 set in position precisely as shown in FIG. 2C and fixed with ample strength was obtained.

EXAMPLE 3

Method for Manufacture of Product Having a Natural Diamond and Corals Fixed to a Ring by Means of a Creaser An Au-containing clayish composition obtained by mixing 95 wt % of Au powder, 15 $\mu$m in average diameter, 0.4 wt % of methyl cellulose, 0.4 wt % of starch, and 0.4 wt % of pulp fibers and kneading the resultant mixture with 3.8 wt % of water added thereto was formed in the shape of a ring. This ring was hardened by drying in a drier at 100° C. for one hour, set in position in an electric furnace having the interior thereof kept at 950° C., fired by heating therein for 30 minutes, then extracted from the electric furnace, and left to cool to room temperature to obtain a sintered formed mass 11 of the shape of a ring.

Figure 3A:
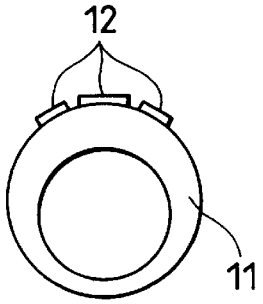
FIGS. 3A, 3B and 3C are schematic diagrams illustrating the process of manufacture used in Example 3.
Figure 3B:
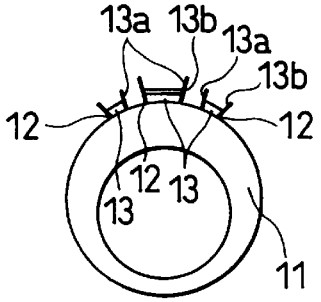

Then, a minute amount of an Au-containing clayish composition 12 was applied to suitable places (three positions) of the outer peripheral part of the sintered formed mass 11 as shown in FIG. 3A. Settings (creasers) 13 were mounted one each on the drops of the Au-containing clayish composition 12 and claw parts 13*a* of the Settings 13 were gently depressed until the Au-containing clayish composition 12 covered outer peripheral parts 13*b* of the Settings 13 in an annular pattern as shown in FIG. 3B.

The formed mass 14 of the shape of a ring manufactured by the procedure described above placed on a refractory brick and heated thereon with the flame of a hand burner using butane gas until it grew red hot.

Then, a natural diamond 15 of oval brilliant cut was set on the settings 13 fixed by firing to the center of the formed mass 14 of the shape of a ring and corals 16 of cubochon cut were set one each on the settings 13 located at opposite sides and claw parts 13*a* of the settings 13 were bent to fix the natural diamond 15 and the corals 16.

Figure 3C:
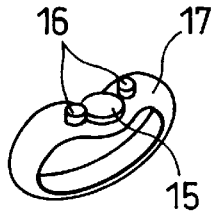

As a result, a beautiful product 17 of the shape of a ring having the natural diamond 15 and the corals 16 set in position precisely as shown in FIG. 3C and fixed with ample strength, was obtained. Neither the diamond nor the corals sustained any damage from high-temperature heating.

EXAMPLE 4

Method for Manufacture of Product Having Natural Diamond Fixed to a Ring by Use of a Creaser A K18-Au-containing clayish composition obtained by mixing 95 wt % of K18-Au powder, 15 $\mu$m in average diameter, 0.4 wt % of methyl cellulose, 0.4 wt % of starch, and 0.4 wt % of pulp fibers and kneading the resultant mixture with 3.8 wt % of water added thereto was formed in the shape of a ring. This ring was hardened by drying in a drier at 90° C. for one hour to obtain a dry formed mass 18 of the shape of a ring.

Figure 4A:
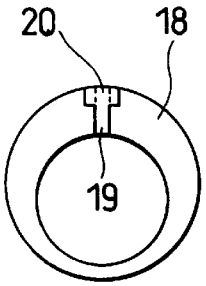
FIGS. 4A, 4B and 4C are schematic diagrams illustrating the process of manufacture used in Example 4.

Then, a through hole 19, 1.5 mm in diameter, was bored with a drill in the dry formed mass 18 as shown in FIG. 4A and the outer peripheral part of the through hole 19 was excavated to a depth of 2 mm with a drill to give rise to a fixing part (setting part) 20.

Figure 4B:
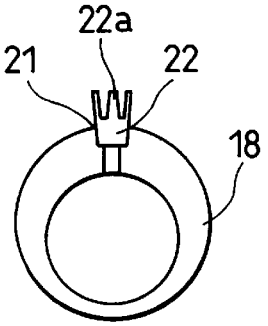

Subsequently, a minute amount of the K18-Au-containing clayish composition 21 was applied to the fixing part 20 as shown in FIG. 4B and a setting 22, 3 mm in diameter, made of K18 Au was set on the fixing part 20.

The formed mass 23 of the shape of a ring manufactured by the procedure described above was set in position in an electric furnac enabling introduction of a reducing gas, quickly heated therein from room temperature to 400° C., retained in the open air at 400° C. for 30 minutes, then heated to 850° C. as continuously swept with the reducing gas and, with the introduction of the reducing gas and the heating discontinued, left standing in the electric furnace until it cooled to below 100° C.

Subsequently, a natural diamond 24 of round brilliant cut was set on the setting 22 fixed to the sintered formed mass 23 of the shape of a ring and a claw part 22*a* of the setting 22 was bent to fix the natural diamond in position.

Figure 4C:
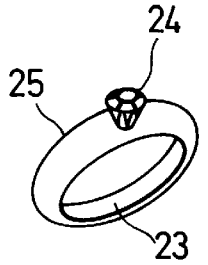

As a result, a beautiful product 25 of the shape of a ring having the natural diamond 24 set in position precisely as shown in FIG. 4C and fixed with ample strength was obtained. The diamond was undamaged by high-temperature heating.

EXAMPLE 5

Figure 5A:
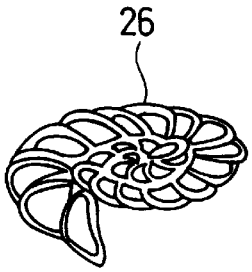
FIGS. 5A, 5B and 5C are schematic diagrams illustrating the process of manufacture used in Example 5.

Method for Manufacture of Product Having a Chain Retaining Piece Attached to an Openwork Pendant Top An injection syringe made of polypropylene and having an inner volume of 2 ml was filled with the same Ag-containing clayish composition as used in Example 1. The Ag-containing clayish composition was extruded from the syringe in the form of a thread in such a manner as to draw the pattern of an ammonite. The formed mass resembling an ammonite was solidified by drying in a drier at 80° C. for 30 minutes to obtain a dry formed mass 26 resembling an ammonite as shown in FIG. 5A.

Figure 5B:
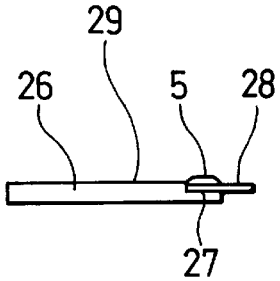

Then, a fixing part 27 was formed by cutting part of the reverse surface of the dry formed mass 26 with a knife as shown in FIG. 5B and a stick ring (chain retaining piece) 28 was attached to the fixing part 27 by the use of a minute amount of the Ag-containing clayish composition 5 to obtain a formed mass 29 of the shape of a pendant top.

The formed mass 29 of the shape of a pendant top obtained by the procedure described above was set on a refractory brick and fired uniformly thereon by heating with the flame of a hand burner using butane gas until it grew red hot.

Figure 5C:
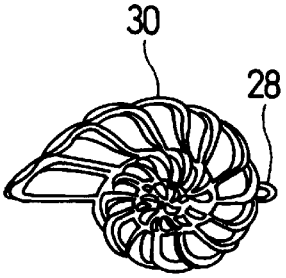

As a result, a beautiful product 30 of the shape of a pendant top having the pattern of an ammonite imparted thereto by the openwork technique and also having the chain retaining piece 28 set in position precisely thereon as shown in FIG. 5C and fixed with ample strength was obtained.

EXAMPLE 6

Method for Manufacture of Product Having Pearl Fixed to Pendant Top with Creaser The same Ag-containing clayish composition as used in Example 1 was formed in the shape of a flat plate having a thickness of 1.5 mm and resembling a pen nib and then hardened by drying at 100° C. for 20 minutes. The hardened flat plate was set in position in a microwave heat generator and heated with a household microwave oven of an output of 500 W for 10 minutes to obtain a sintered formed mass 31 of the shape of a flat plate.

Figure 6A:
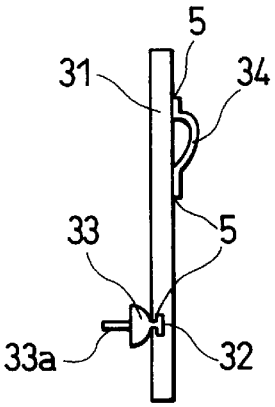
FIGS. 6A and 6B are schematic diagrams illustrating the process of manufacture used in Example 6.

Then, a fixing part (fitting part) 32 was formed by incising a groove in part of the obverse surface of the formed mass 31 mentioned above by the use of a carving chisel as shown in FIG. 6A. A loop (pearl setter) 33 was attached to the fixing part 32 and a back bail (chain retaining piece) 34 was attached at a suitable position on the reverse side of the sintered formed mass 31, by the use of a minute amount of the Ag-containing clayish composition 5 as an adhesive agent. The resultant composite was heated with the flame of a hand burner using butane gas until it grew red hot to effect powerful fixation of the loop 33 and the back bails 34 to the sintered formed mass 31.

A pearl 36 was fixed to a fitting part 33*a* of the Tsukisashi 33 of the formed mass 35 of the shape of a pendant top obtained by the procedure described above.

Figure 6B:
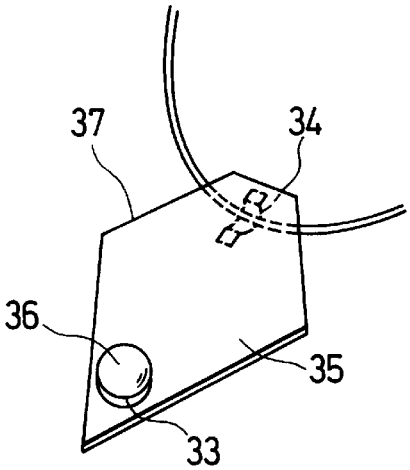

As a result, a beautiful product 37 of the shape of a pendant top having the pearl 36 and the chaining piece 34 set in position precisely thereon as shown in FIG. 6B and fixed with ample strength was obtained.

While there have been shown and described several preferred embodiments of the invention, it should be noted that the present invention is not limited thereto but may be otherwise variously embodied and practiced without departure from the scope of the claims.

The present invention as described above is capable of fixing an accessory such as a gem or a metallic part such as a stone setter or Bachikan with extremely high strength without encountering such inconveniences as inclination or protrusion or submergence from the desired position.

Even when the highest temperature endurable by the accessory is lower than the sintering temperature of the metallic powder used in the clayish composition, the present invention enables the accessory to be fixed to the matrix by the subsequent work using a stone setter. Thus, this invention can be effectively applied to pearl and coral and to such gems as natural diamond which have high decorative value but low endurance temperature. Thus, this invention enjoys a broad scope of application and manifests a notably high effect.

Particularly, the clayish composition which is obtained by kneading at least one precious metal powder selected from among precious metal powder and precious metal alloy powders with an organic binder and water while having the organic binder formed by combining starch with a water-soluble cellulose and pulp fibers does not adhere to the hands during the course of forming. The formed mass which is made of this clayish composition is prevented from sustaining a cracks and enabled to acquire an increase in the drying strength and to elongate the period of during which the formed mass remains formable.

What is claimed is:

1. A method for the manufacture of a precious metal product, consisting essentially of the steps of forming in a desired shape a clayish composition essentially consisting of a precious metal powder, an organic binder and water, solidifying the formed clayish composition to obtain a solid formed mass, attaching an accessory member fast to said solid formed mass with a portion of said clayish composition serving as an adhesive agent, and firing the resultant composite having said accessory member fastened to said solid formed mass.

2. A method according to claim 1, wherein said solidification of said formed mass made of said clayish composition is effected by drying.

3. A method according to claim 1, wherein said solidification of said formed mass made of said clayish composition is effected by sintering.

4. A method according to claim 1, wherein said solid formed mass is preparatorily formed so as to form thereon a fixing part capable of seating a fixing member and then said fixing member is joined by adhesion to said fixing part.

5. A method according to claim 1, wherein said clayish composition consists essentially of 90–99 wt % of at least one member selected from among pure precious metal powders and precious metal alloy powders, 0.1–10 wt % of an organic binder, and water.

6. A method according to claim 1, wherein said precious metal is at least one member selected from among Au, Ag, Pt, Pd, Rh, Ru, Ir, and Os.

7. A method according to claim 1, wherein said organic binder comprises 0.02–4.0 wt % of starch, 0.02–4.0 wt % of a water-soluble cellulose, and 0–3.0 wt % of pulp fibers.

* * * * *